US009028134B2

(12) United States Patent
Koshoji et al.

(10) Patent No.: US 9,028,134 B2
(45) Date of Patent: May 12, 2015

(54) WATERPROOF PUSH OPERATION MEMBER FOR A TIME PIECE

(71) Applicant: Seiko Instruments Inc., Chiba-shi, Chiba (JP)

(72) Inventors: Hideaki Koshoji, Chiba (JP); Haruki Hiranuma, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 14/184,302

(22) Filed: Feb. 19, 2014

(65) Prior Publication Data

US 2014/0233360 A1 Aug. 21, 2014

(30) Foreign Application Priority Data

Feb. 20, 2013 (JP) ..... 2013-031364

(51) Int. Cl.

| | |
|---|---|
| ***H01H 3/12*** | (2006.01) |
| ***G04B 37/10*** | (2006.01) |
| ***H01H 13/06*** | (2006.01) |
| *H01H 9/04* | (2006.01) |

(52) U.S. Cl.

CPC ..... *G04B 37/106* (2013.01); *G04B 37/10* (2013.01); *H01H 3/12* (2013.01); *H01H 13/06* (2013.01); *H01H 2009/048* (2013.01); *H01H 2231/028* (2013.01); *H01H 2300/016* (2013.01)

(58) Field of Classification Search

CPC ..... G04B 37/106; G04B 3/048; G04B 3/001; G04B 3/046; G04B 37/10; H01H 3/12; H01H 9/04; H01H 13/06; H01H 2009/048; H01H 2231/028; H01H 2300/016

USPC ..... 368/206, 288–291, 306–308, 319–321

See application file for complete search history.

(56) References Cited

U.S. PATENT DOCUMENTS

| | | | | |
|---|---|---|---|---|
| 2,482,317 | A * | 9/1949 | Borer | 368/288 |
| 3,362,154 | A * | 1/1968 | Perret | 368/290 |
| 3,453,819 | A * | 7/1969 | Simon | 368/290 |
| 5,257,247 | A * | 10/1993 | Miche et al. | 368/290 |
| 6,872,899 | B2 | 3/2005 | Oshio et al. | |
| 2008/0285390 | A1* | 11/2008 | Cretin et al. | 368/290 |
| 2009/0147630 | A1 | 6/2009 | Clerc et al. | |
| 2012/0263023 | A1* | 10/2012 | Koshoji et al. | 368/308 |

FOREIGN PATENT DOCUMENTS

| | | |
|---|---|---|
| JP | 2004-319446 A | 11/2004 |
| JP | 2009-133859 A | 6/2009 |

* cited by examiner

*Primary Examiner* — Amy Cohen Johnson
*Assistant Examiner* — Matthew Powell
(74) *Attorney, Agent, or Firm* — Brinks Gilson & Lione

(57) ABSTRACT

The present invention is to provide a portable device, such as a wrist watch, which realizes, with a simple structure, improved waterproof property against water leak associated with a push-in operation. A wrist watch (portable device) includes an outer case (device outer housing), an operation member and a holding ring. The outer case includes a holding portion in which an annular bearing surface is formed. The operation member is made of a soft material having waterproof performance. The operation member includes an annular packing portion to be seated on the bearing surface and a push-in portion integrally connected to the bearing portion, to which the push-in operation is performed from the outside of the device outer housing.

15 Claims, 7 Drawing Sheets

WATERPROOF PUSH OPERATION MEMBER FOR A TIME PIECE

RELATED APPLICATIONS

This application claims priority under 35 U.S.C. §119 to Japanese Patent Application No. 2013-031364 filed on Feb. 20, 2013, the entire content of which is hereby incorporated by reference.

BACKGROUND OF THE INVENTION

1. Field of the Invention

The present invention related to a portable device and a portable timepiece including a push-in operation portion.

2. Description of the Related Art

In portable devices including timepieces such as a wrist watch and a pocket watch, a stopwatch, a cellular phone and a portable information terminal device, there are devices, for example, including an operation member such as a push bottom for operating contacts in a device outer housing, which is attached to the device outer housing. In such device, given functions are executed when the push button is pushed given times of strokes. For example, in the portable timepiece, a dial window can be illuminated, a timepiece display can be switched from an analog display to a digital display or can be inversely switched and further, the date or the day of the week which is digitally displayed can be modified.

As a shaft portion of the push button pierces the device outer housing from inside to outside in such kind of portable device, it is necessary to waterproof a portion at which the push button is formed (push-in operation portion).

In order to realize the above, a structure of waterproofing between the shaft portion of the push button and the device outer housing by fitting a seal material which has a ring shape and can be elastically deformed to the outer periphery of the shaft portion of the push button piercing a pipe fixed to the device outer housing, and allowing the seal material to be closely contacted with an inner surface of the pipe in a state where the seal material is compressed in a radial direction (refer to JP-A-2004-319446 (Patent Literature 1)).

There is also proposed a structure in which a cap covering a head portion of a push button having a shaft portion piercing an outer case from inside to outside is provided to waterproof the push button. That is, the cap is made of a flexible waterproof material, including an annular peripheral collar on an opened end side as well as including an annular lip integrally connected to the color and sectioning the opening. When a securing ring fitted to the outer periphery of the cap is fixed to the outer case by two screws, the peripheral collar is sandwiched between the securing ring and the outer case to thereby fix the cap to the outer case. This fixing allows the annular lip of the cap to abut on a bottom face of a groove formed in the outer case and to be held in a slightly compressed state, which realizes a waterproof structure (for example, refer to JP-A-2009-133859 (Patent Literature 2)).

In the waterproof structure described in Patent Literature 1, when the push button is moved in an axial direction, the seal material slides along an inner surface of the pipe. Accordingly, for example, under a condition in which the portable device is exposed to water, for example, in the case where the push button is operated in water, as the sealing performance becomes unstable because portions sealed by the seal material is moved with the push button, the waterproof performance may be reduced at a portion where the push button is arranged.

Moreover, foreign matter such as grains of sand may enter between the seal material and the inner surface of the pipe from the outside of the push button, which may be bitten between the seal material and the inner surface of the pipe. Under the above circumstances, there is a danger that waterproof property is reduced at the portion where the push button is arranged.

In the waterproof structure described in Patent Literature 2, as screws fixing the securing ring are arranged 180 degrees apart from each other around the cap, it is difficult to sufficiently secure a force of sandwiching the peripheral collar at positions 90 degrees apart from these two screws in a circumferential direction of the cap, therefore, water may climb over the peripheral collar and enter the annular lip side in water and other places. Therefore, when the cap is elastically deformed in water and the push button covered by the cap is operated, there is a danger that the waterproof property is reduced. That is, as the cap is pressed in water, the pressing force to be affected on the annular lip may move the annular lip with deformation. As a result, as the waterproof performance due to the annular lip becomes unstable, there is a danger that the waterproof property is reduced.

Furthermore, in the waterproof structure described in Patent Literature 2, the waterproof structure is realized by using the cap, the securing ring and two screws. Accordingly, the number of components for the waterproof structure is large and the structure is complicated, therefore, the number of assembly processes for the waterproofing is also large as well as the number of processes with respect to the outer case which are necessary for screwing the securing ring is also large. Accordingly, it is disadvantageous on reducing costs.

The related art techniques have problems that there is room for improvement on the waterproof performance around the push button as well as there is room for improvement on simplifying the structure and reducing costs.

SUMMARY OF THE INVENTION

An object of the present invention is to provide a portable device and a portable timepiece capable of improving the waterproof property in the push-in operation portion with a simple structure.

In order to solve the above problems, a portable device according to an embodiment of the present invention includes a device outer housing including a holding portion in which a bearing surface is formed, an operation member including a packing portion to be seated on the bearing surface and a push-in portion integrally connected to the portion, to which push-in operation is performed from the outside of the device outer housing, which is made of a soft material having waterproof performance, and a holding ring including a presser portion sectioning an opening pierced by the push-in portion as well as contacting the packing portion, and a cylindrical portion integrally connected to the presser portion and arranged around the holding portion to attach the operation member to the device outer housing, which holds the operation member in a state of being attached to the device outer housing so that the presser portion and the bearing surface sandwich the packing portion in a state of being compressed in a thickness direction of the portion.

The portable device according to the present invention can be applied to timepieces such as a wrist watch and a pocket watch, a stopwatch, a cellular phone and a portable information terminal device, and the device outer housing indicates an outer case and so on. In the invention, the holding portion may be integrally formed with an outer housing components included in the device outer housing. In the invention, the operation member turns on/off a switch provided in the device outer housing and so on for controlling a device housed in the device outer housing. In this case, the switch may be operated by using the push shaft to be moved so as to protrude inside the device outer housing in conjunction with the push-in operation of the push-in portion, or it is also possible to turn on/off a switch arranged inside the operation member for controlling a device housed in the device outer housing by the push-in operation of the push-in portion and the release thereof without using the push shaft. Though it is preferable to provide a spring and so on for returning the push-in member to an original state as a push-in operation force disappears as well as for giving a feel on the push-in operation, the spring can be omitted.

As a soft material forming the operation member in the invention, soft plastic such as soft polypropylene and soft vinyl chloride, soft resin such as elastomer or synthetic rubber such as fluorine rubber and silicone rubber can be used. The push-in portion of the operation member may be the push-in portion to be restored to the original state before being pushed by elasticity of itself as the push-in operation force is not added, or may be the push-in portion to be restored to the original state before being pushed by a spring force as the push-in operation force is not added.

In the invention, it is possible to fulfill given functions included in the device by operating the switch and so on controlling the device housed in the device outer housing based on the push-in operation performed by the push-in portion of the operation member. In the invention, waterproofing with respect to the inside of the operation member is realized by the place where the bearing surface included in the holding portion of the device outer housing and the presser portion of the holding ring sandwich the packing portion of the operation member in the state of being compressed in the thickness direction of the portion, namely, the annular seal portion. Accordingly, variations hardly occur in the sealing performance at respective positions of the seal portion. Furthermore, as the holding portion and the holding ring are not moved improperly, the seal portion is not moved as the push-in portion is pushed in, or the push-in portion is restored to the state before being pushed. Accordingly, the sealing performance in the seal portion does not become unstable. Additionally, as the operation member is attached to the device outer housing by the cylindrical portion of the holding ring, any part for fixing the holding ring to the device outer housing is not necessary.

As a result, according to the present invention, it is possible to improve waterproof property in the push-in operation portion formed by including the holding portion, the operation member and the holding ring with the simple structure.

In the portable device in a preferable mode of the present invention, the device outer housing may include a through hole piercing the center of the holding portion, and a push shaft may be inserted into the through hole, which can be pushed into the device outer housing through the push-in portion covering the push shaft.

In the preferable mode, the push shaft is moved so as to protrude into the device outer housing by the push-in portion as the push-in operation is performed to the push-in portion of the operation member, and the switch or the like controlling a built-in device housed in the device outer housing is operated by the push shaft. Accordingly, it is possible to fulfill given functions included in the device. The annular seal portion is not moved in conjunction with the movement of the push shaft, it is possible to improve waterproof performance in the push-in operation portion with the simple structure.

In the portable device in a preferable mode of the present invention, the holding portion may include a male screw portion at an outer periphery thereof and the cylindrical portion includes a female screw portion at an inner periphery thereof, and the operation member may be attached to the device outer housing by screwing the male screw portion into the female screw portion.

In the preferable mode, the compression degree of the packing portion of the operation member (in other words, sealing performance of the seal portion) can be adjusted by the degree of screwing the holding ring with respect to the holding portion of the device outer housing. Moreover, as the screwing between the female screw portion and the male screw portion can be released relatively easily, it is possible to take apart the seal portion and replace the operation means.

In the portable device in a preferable mode of the present invention, a gap may be provided between an outer surface of the device outer housing connected perpendicular to the holding portion and an end surface of the cylindrical portion.

In the preferable mode, the holding ring can be screwed into the holding portion until the gap disappears. The deeper the screwing is, the stronger the compression degree of the packing portion becomes. Accordingly, the sealing performance of the seal portion can be improved by allowing the screwing of the holding ring to be deeper.

In the portable device in a preferable mode of the present invention, the operation member may include a cylindrical sandwiched portion integrally connected to the packing portion to be fitted to the outer periphery of the holding portion, and the operation member may be attached to the device outer housing by the cylindrical portion pressed in an outer periphery of the sandwiched portion so that the holding portion and the cylindrical portion sandwich the sandwiched portion in a state of being compressed in a thickness direction of the portion.

In the preferable mode, as the sandwiched portion sandwiched by the holding portion and the cylindrical portion fulfills waterproof performance, waterproof performance in the push-in operation portion can be further improved. Moreover, it is not necessary to form screw portions respectively in the holding portion and the cylindrical portion when the operation member is attached to the device outer housing, therefore, process costs with respect to the holding portion and the cylindrical portion can be reduced.

In the portable device in a preferable mode of the present invention, the device outer housing may further include a cylindrical supporting portion connected perpendicular to the bearing surface and supporting the push-in portion from the inside.

In the preferable mode, the operation member is positioned with respect to the holding portion by fitting the push-in portion to the outer periphery of the supporting portion. Accordingly, it is possible to prevent the packing portion from moving in a radial direction when the push-in operation portion is assembled.

In the portable device in a preferable mode of the present invention, an inside diameter of the supporting portion may be larger than a diameter of the through hole, and the push shaft may include a head portion guided in an inner peripheral surface of the supporting portion.

In the preferable mode, when the push shaft is moved in the axial direction, the head portion of the push shaft can be guided by the supporting portion to thereby allow the movement of the push shaft to be stable.

In the portable device in a preferable mode of the present invention, the device outer housing may include a shell having a pipe mounting hole and a holder integrally connected to the shell, and the holder may include a pipe portion inserted into the pipe mounting hole, in which the through hole is formed, and the holding portion may be formed in the holder.

In the preferable mode, as the holder and the shell are separate parts, a mold for molding the shell is not complicated as compared with the case of molding the shell integrally having the holding portion. Additionally, as the holding portion can be processed in the holder as a separate component from the shell regardless of the shell, it is possible to reduce process costs of the mold for molding as compared with the case where the shell is processed and the holding portion is formed integrally with the shell.

In order to solve the above problems, a portable timepiece according to an embodiment of the present invention is formed by a portable device according to any one of the respective inventions.

According to the present invention, the portable timepiece is formed by the portable device according to any one of the respective inventions, therefore, it is possible to provide a portable timepiece capable of improving waterproof property in the push-in operation portion with a simple structure.

According to the present invention, the number of parts necessary for waterproofing the push-in operation portion is reduced, therefore, it is possible to provide a portable device and a portable time piece capable of improving waterproof property in the push-in operation portion with a simple waterproof structure as the seal portion configured by the packing portion in the operation member, the bearing surface in the holding portion and the presser portion in the holding ring which sandwich the packing portion does not move in conjunction of the push-in operation of the push-in portion included in the operation member.

DETAILED DESCRIPTION OF THE PREFERRED EMBODIMENTS

A first embodiment of the present invention will be explained with reference to FIG. 1 to FIG. 3.

Figure 1:
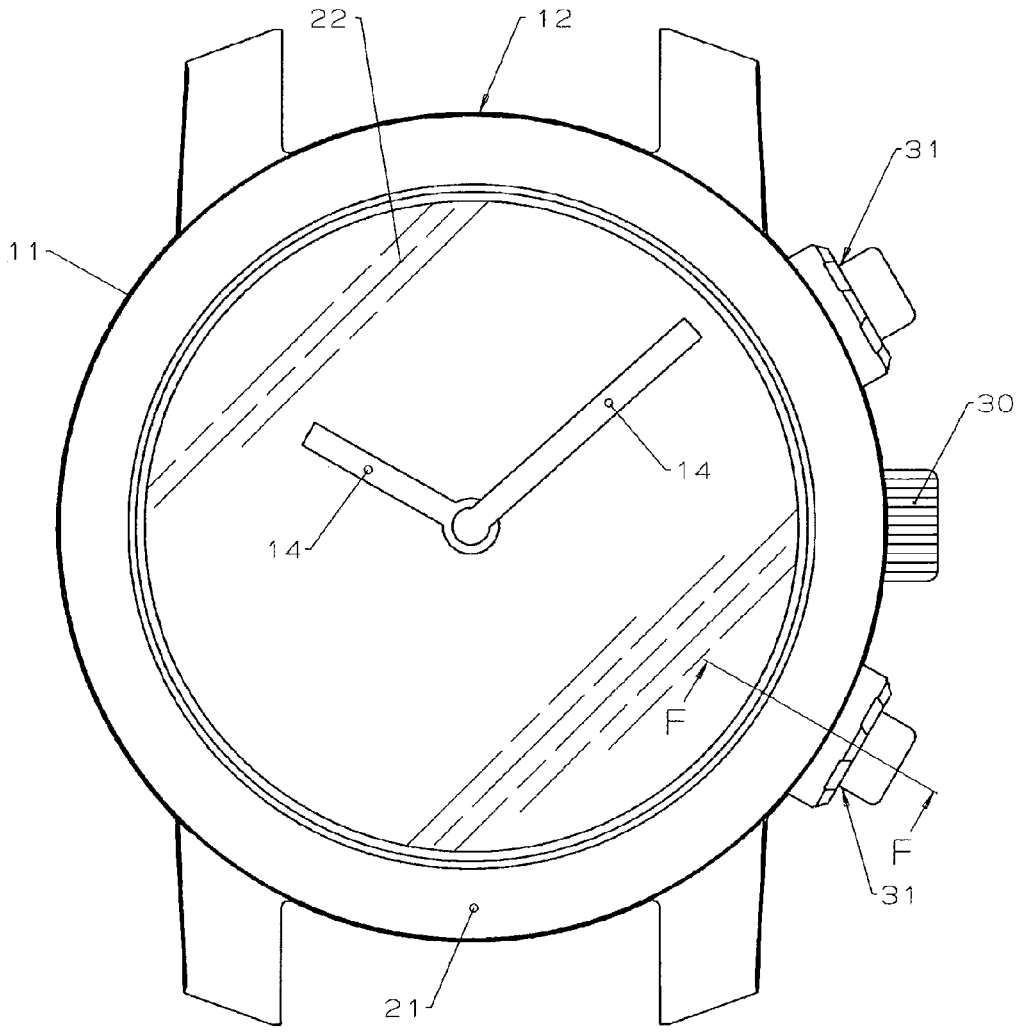
FIG. 1 is a front showing a wrist watch according to a first embodiment of the present invention.
Figure 2:
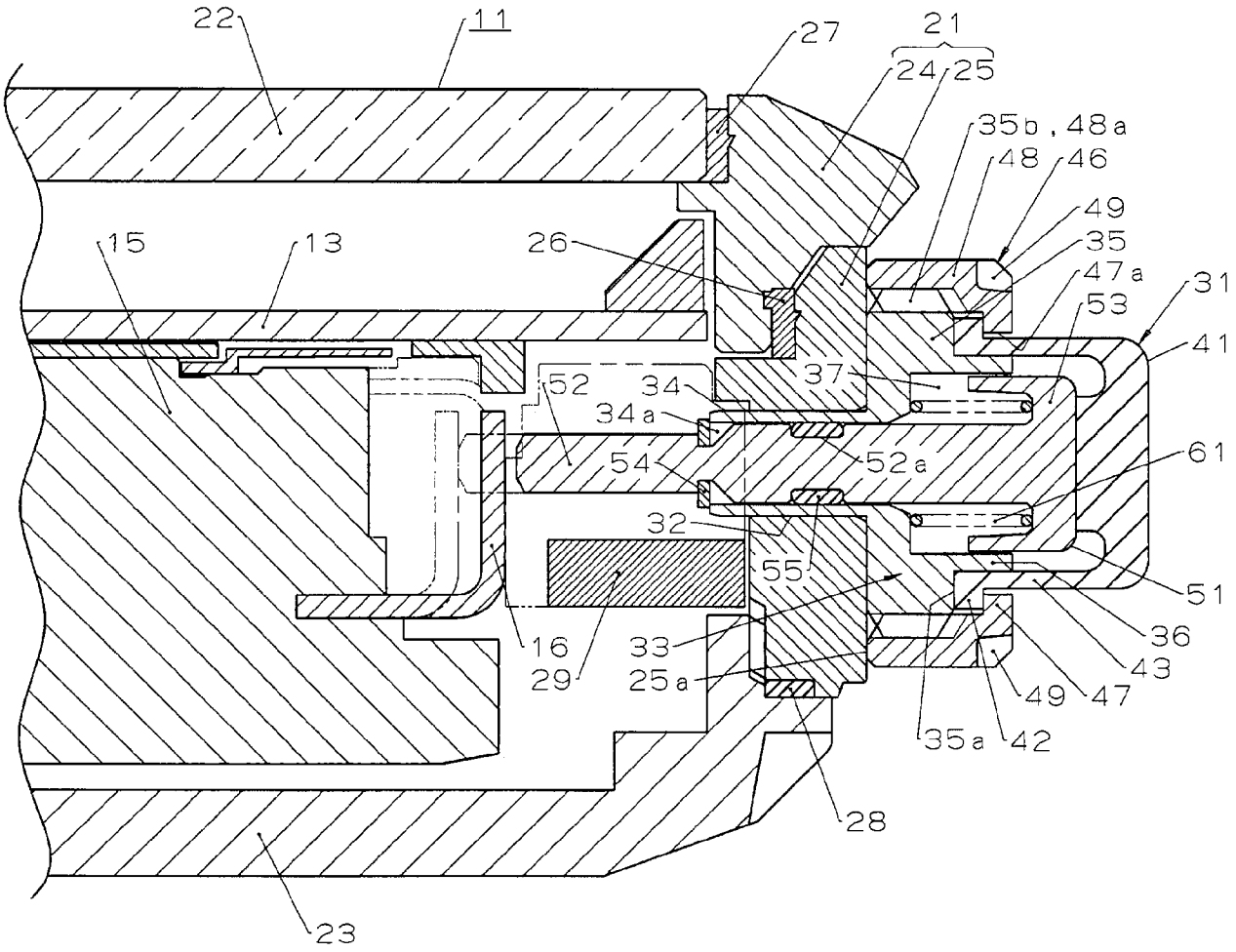
FIG. 2 is a cross-sectional view of the wrist watch shown along F-F line of FIG. 1.
Figure 3:
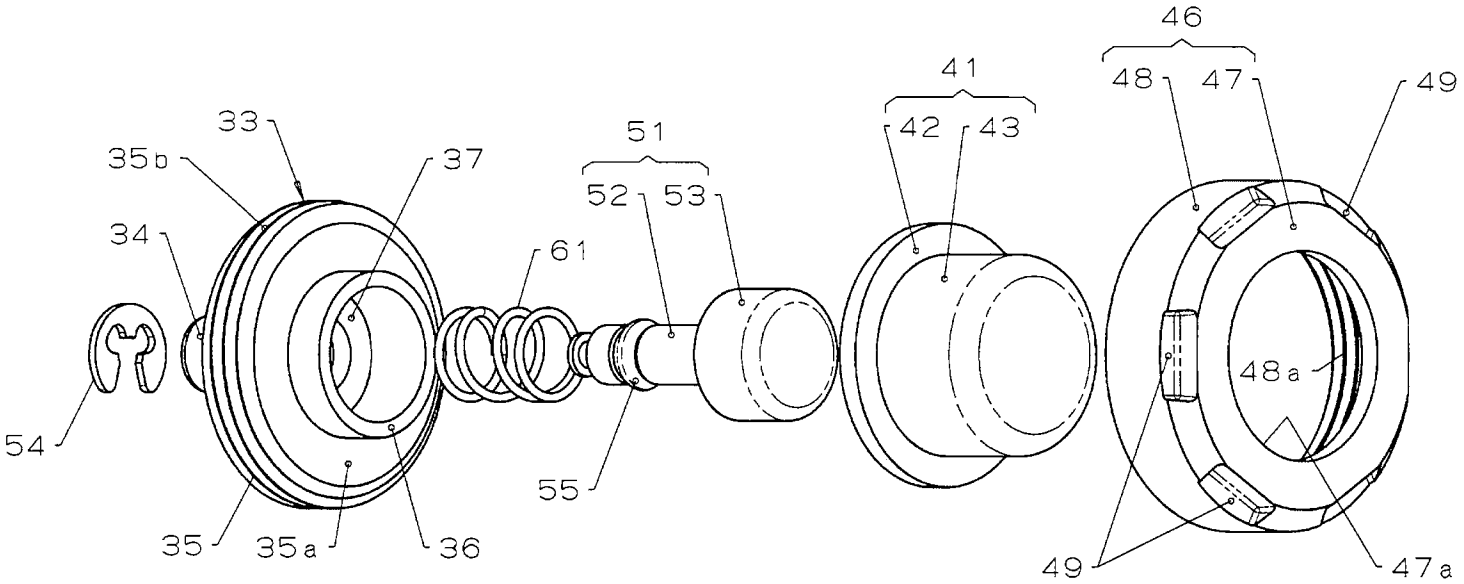
FIG. 3 is a perspective view showing a push-in operation portion included in the wrist watch of FIG. 1 in an exploded manner.

A numeral 11 in FIG. 1 and FIG. 2 denotes a portable device, for example, a portable timepiece, which is specifically, a wrist watch having waterproof performance capable of being used in water. The wrist watch 11 includes a device outer housing, for example, an outer case 12 for the timepiece.

As shown in FIG. 2, a display window such as a dial window 13, an internal device such as a movement 15 controlling the movement of hour hands 14 (refer to FIG. 1) displaying time, a not-shown lamp, a power supply such as a not-shown battery and so on are housed inside the outer case 12.

The movement 15 includes at least one reaction member, for example, two contact members 16 (only one member is shown in FIG. 2). These contact members 16 are formed by leaf springs and so on and protrude from the outer periphery the movement 15. When the contact members 16 are pushed by later-described push-in operation portions 31, the movement 15 and so on fulfill functions given to respective push-in operation portions 31. For example, the push-in operation portion 31 on the upper right in FIG. 1 has a function of start/stop for measuring time, and the push-in operation portion 31 on the lower right has a function of turning on/off the lamp.

As shown in FIG. 2, the outer case 12 is formed so that a cover glass 22 through which the dial window 13 can be seen is liquid-tightly attached to the front surface of a shell 21 formed in an annular shape and made of a metal such as stainless steel or titanium, a synthetic resin and so on, and a back cover 23 made of a metal, a synthetic resin or the like is liquid-tightly attached to the back surface of the shell 21. In the embodiment, the shell 21 is formed by integrating a first shell member 24, for example, made of a metal, to which the cover glass 22 is attached and a second shell member 25 to which the back cover 23 is attached with each other by brazing and so on. However, the present invention is not limited to the above, and the shell 21 can be a single component.

A numeral 26 in FIG. 2 denotes a packing for sealing between the first shell member 24 and the second shell member 25 which are connected to each other, and numerals 27 and 28 respectively denote packing for holding liquid tightness of the outer case 12. A numeral 29 in FIG. 2 denotes an inner frame supporting the movement 15, and further, a numeral 30 in FIG. 1 denotes a winder for operating the movement 15.

The push-in operation portions 31 are provided at given places of the outer case 12, for example, two places of the shell 21 forming a circumferential side wall of the outer case 12, and specifically, on both sides of the winder 30 sandwiching the winder 30 (the upper side and the lower side of the winder 30 in FIG. 1). As these push-in operation portions 31 have the same structure, the push-in operation portion 31 having a function of turning on/off the lamp illuminating the dial window 13 will be explained here as a representative with reference to FIG. 2.

The push-in operation portion 31 includes, as described later, a holding portion 35 included in the outer case 12, a supporting portion 36, a through hole 34*a*, an operation member 41 arranged so as to cover the holding portion 35, a holding ring 46 allowing the operation member 41 to be held by the holding portion 35, a push shaft 51 to be pushed by the operation member 41 so as to protrude in the outer case 12 and a spring 61 returning the push shaft 51 to an original position before being pushed.

Specifically, the shell 21 of the outer case 12 includes a pipe mounting hole 32 having a round hole as well as a holder 33. The pipe mounting hole 32 is formed so as to pierce the second shell member 25 along a radial direction of the shell 21. The holder 33 is a component made of, for example, the same kind of material as the second shell member 25 and molded separately from the second shell member 25, which is connected to the second shell member 25 by using a not-shown brazing filler metal. Accordingly, the holder 33 and the second metal member 25 are integrated to each other.

The holder 33 includes a pipe portion 34, the holding portion 35, the supporting portion 36 and a concave portion 37. A cross section of the pipe portion 34 in a direction orthogonal to a direction in which the central axis line of the pipe portion 34 extends has a circular-ring shape, and both ends of the pipe portion 34 are respectively closed.

The holding portion 35 is formed so as to connect to the outer periphery of one end of the pipe portion 34, which has a larger diameter than the pipe portion 34. The holding portion 35 includes a bearing surface 35*a* and a male screw portion 35*b*. The bearing surface 35*a* is formed by a surface of the holding portion 35 positioned on the opposite side of the direction in which the pipe portion 34 protrudes with respect to the holding portion 35, namely, the surface extending along the direction orthogonal to the central axis line of the holder 33. The bearing surface 35*a* has a circular-ring shape centering on the central axis line of the holder 33. The male screw portion 35*b* is formed on the outer periphery of the holding portion 35 connected perpendicular to the bearing surface 35*a*.

The supporting portion 36 has a cylindrical shape having a smaller diameter than the holding portion 35, which is connected perpendicular to the bearing surface 35*a* as well as formed so as to protrude in the opposite direction to the direction in which the pipe portion 34 protrudes with respect to the holding portion 35. The concave portion 37 is formed in the holding portion 35 so that the supporting portion 36 sections the periphery thereof, which opens to the opposite side of the direction in which the pipe portion 34 protrudes with respect to the holding portion 35. Therefore, an inside diameter of the concave portion 37, in other words, the inside diameter of the supporting portion 36 is larger than an inside diameter of the pipe portion 34, and the pipe portion 34 opens to a bottom face of the concave portion 37.

The holder 33 having the structure explained above is bonded to the second shell member 25 by brazing in a state where the pipe portion 34 is inserted into the pipe mounting hole 32 from the outside of the shell 21 as well as the holding portion 35 contacts an outer surface 25*a* of the second shell member 25. The outer case 12 has the through hole 34*a* formed by an internal space of the pipe portion 34. The through hole 34*a* pierces the center of the holding portion 35 and connects the inside to the outside of the shell 21.

The holder 33 may be integrally molded with the second shell member 25. In this case, there is no structure corresponding to the pipe portion and the pipe mounting hole, and the through hole 34*a* is formed so as to pierce the second shell member 25 and connect the inside to the outside of the shell 21.

The structure in which the holder 33 and the shell 21 are molded as separate components and integrated together does not complicate a mold for molding the shell 21 as compared with the case of forming the shell 21 integrally having the holding portion 35. Accordingly, it is possible to reduce molding costs to thereby contribute to the cost reduction of the overall wrist watch. Furthermore, the holding portion 35 can be processed in the holder 33 as a separate component from the shell 21 regardless of the shell 21. Accordingly, it is possible to reduce process costs as compared with the case where the shell 21 is processed and the holding portion 35 is integrally formed with the shell 21, which can contribute to the cost reduction of the overall wrist watch.

The operation member 41 is an integral molding product made of soft materials having the waterproof performance. As soft materials, materials having high resistance to seawater and so on as well as capable of being deformed freely, preferably materials capable of being deformed elastically, specifically, silicone rubber and the like can be suitably used. The operation member 41 is formed by including a packing portion 42 and a push-in portion 43 as shown in FIG. 2 and FIG. 3.

The push-in portion 43 has a cap shape with a peripheral wall having cylindrical shape, in which a central portion of a closed end wall protrudes on the back surface side and formed to be thicker than other portions. An inside diameter of the push-in portion 43 is approximately the same as an outside diameter of the supporting portion 36 as well as the length of the push-in portion 43 in the axial direction is longer than a protruding size of the supporting portion 36 with respect to the bearing surface 35*a*. The packing portion 42, for example, sections an opening of the operation member 41, which integrally protrudes outside so as to be connected from the peripheral wall of the push-in portion 43. The packing portion 42 is formed in a ring shape which is approximately the same shape as the bearing surface 35*a*.

The operation member 41 is arranged so that the packing portion 42 is seated on the bearing surface 35*a* as well as the push-in portion 43 is fitted to an outer surface of the supporting portion 36. The push-in portion 43 of the operation member 41 can perform a pushing operation from the outside toward the inside of the outer case 12 as well as can be returned to the original state before being pushed by receiving a force in the direction opposite to the pushing direction from the inside.

The holding ring 46 is preferably made of a metal or a hard synthetic resin in the same kind as the holder 33. The holding ring 46 has a presser portion 47 and a cylindrical portion 48 integrally formed with the pressure portion 47.

The presser portion 47 is a portion contacting the packing portion 42 to sandwich the packing portion 42 with the bearing surface 35*a*, which is formed in a ring shape by sectioning an opening 47*a*. A diameter of the opening 47*a* is larger than an outside diameter of the push-in portion 43. The cylindrical portion 48 connected to the pressure portion 47 has a cylindrical shape, in which a female screw portion 48*a* to be screwed to the male screw portion 35*b* of the holder 33 so as to be removable in an inner periphery of the cylindrical portion 48. Numerals 49 in FIG. 2 and FIG. 3 denote engaging concave portions opening to an outer surface of a corner portion formed by the presser portion 47 and the cylindrical portion 48 as well as formed in a circumferential direction at intervals. The holding ring 46 is rotated in a state where a not-shown tool engages with the engaging concave portions 49.

A push shaft 51 is an integral molding product made of a metals or a hard synthetic resin, which includes a shaft portion 52 and a head portion 53.

The shaft portion 52 has a columnar shape and is longer than a shaft length of the pipe portion 34. The shaft portion 52 pierces the pipe portion 34 so as to be moved in the axial direction, and a snap ring 54 for preventing the push shaft 51 from falling off from the pipe portion 34 is attached to a shaft end (tip portion) of the shaft portion 52 protruding inside the shell 21. The snap ring 54 is made of a metal, having a C-shape or an E-shape with a size enough to be engaged with an end face of the pipe portion 34 from the inside of the shell 21.

The head portion 53 which is integrally formed at an end of the shaft portion 52 has a cylindrical peripheral wall. An outside diameter of the peripheral wall is slightly smaller than an inside diameter of the concave portion 37. The head portion 53 can slide along an inner peripheral surface of the supporting portion 36.

A packing mounting groove 52*a* is formed at an intermediate portion of the shaft portion 52 in the axial direction. Additionally, a packing 55 having functions of waterproofing and dustproofing is attached to the packing mounting groove 52*a*. The packing 55 is made of a rubber-based or a plastic-based material to be elastically deformed in a ring shape, which can slide along an inner peripheral surface of the pipe portion 34. The liquid-tight sealing between the pipe portion 34 and the shaft portion 52 is realized by the packing 55.

A spring 61 is formed by a coil spring, and both ends thereof contact a bottom face of the concave portion 37 and a rear face of the head portion 53 facing the bottom face and are sandwiched by these faces in a compressed state. The spring 61 can be further compressed when the push shaft 51 is pushed. The push shaft 51 is biased toward the outside of the outer case 12, specifically, toward the outside direction of the shell 21 by a spring force of the spring 61. Accordingly, the snap ring 54 is held in a state of being engaged with the end face of the pipe portion 34 protruding inside the outer case 12. Additionally, the head portion 53 contacts the push-in portion 43 and is held in a state where the push-in portion 43 is biased toward the outside direction of the shell 21.

Next, a procedure of assembling the push-in operation portion 31 will be explained. In this case, the holder 33 included in the shell 21 is previously bonded to the second shell member 25 by brazing.

First, the shaft portion 52 is inserted to the through hole of the shell 21 to which the back cover 23 is not attached, namely, the through hole 34*a* formed in the holder 33 from the outside toward the inside of the shell 21 in a state where the spring 61 is freely fitted to the outer periphery of the shaft portion 52 of the push shaft 51 to which the packing 55 is attached to thereby compress the spring 61. The snap ring 54 is attached to the shaft portion 52 inside the shell 21 in the above state of insertion.

According to the above process, the snap ring 54 is engaged with the tip of the pipe portion 34 to thereby maintain the compressed state of the spring 61. Additionally, the packing 55 is in a state of being compressed in a diameter reducing direction with elastic deformation and closely contacts the inner surface of the through hole 34*a* so as to be slidable. Accordingly, liquid-tight sealing is realized between the inner surface of the through hole 34*a* and the shaft portion 52.

Next, an inner peripheral surface of the push-in portion 43 included in the operation member 41 is fitted to the outer periphery of the supporting portion 36 of the shell 21 at the outside of the shell 21, and the packing portion 42 of the operation member 41 is seated on the bearing surface 35*a* of the holder 33. Accordingly, the operation member 41 covers the head portion 53 of the push shaft 51 protruding to the outside of the shell 21 and the operation member 41 is arranged so that an inner face of the push-in portion 43 contacts an end wall of the head portion 53. Accordingly, the operation member 41 is arranged so that the shaft portion 52 can be pushed to the inside of the outer case 12 through the push-in portion 43 as the push-in portion 43 is pushed from the outside of the outer case 12 toward the inside of the outer case 12.

In the work of arranging the operation member 41, the operation member 41 can be positioned with respect to the holding portion 35 of the holder 33 as the push-in portion 43 is fitted to the outer periphery of the supporting portion 36 as described above, thereby facilitating the assembly of the push-in operation portion 31.

Lastly, the holding ring 46 is attached to the holder 33 at the outside of the outer case 12. That is, the cylindrical portion 48 included in the holding ring 46 is arranged around the holding portion 35 included in the holder 33 while allowing the push-in member 43 of the operation member 41 to pierce the opening 47*a* included in the holding ring 46, thereby attaching the operation member 41 to the outer case 12. In this case, the female screw portion 48*a* formed on the inner surface of the cylindrical portion 48 is screwed to the male screw portion 35*a* formed on the outer periphery of the holding portion 35.

The state in which the operation member 41 is attached to the outer case 12 will be shown in FIG. 2. In this state, the pressure portion 47 of the holding ring 46 and the bearing surface 35*a* sandwich the packing portion 42 contacting them in a compressed state in a thickness direction of the portion. The presser portion 47, the bearing surface 35*a* and the packing portion 42 sandwiched by them form a seal portion for liquid-tightly sealing between the outer case 12 and the push-in operation portion 31 attached to the outer case 12.

As the operation member 41 is positioned with respect to the holder 33 as described above when the seal portion is assembled, it is possible to prevent the packing portion 42 from being moved in the radial direction by the supporting portion 36 when the packing portion 42 is sandwiched between the presser portion 47 and the bearing surface 35*a*. Accordingly, it is possible to assemble the seal portion while sandwiching the packing portion 42 by the pressure portion 47 and the bearing surface 35*a* positively.

In the case where the packing portion 42 is not properly sandwiched in the assembly, the packing portion 42 protrudes from the opening 47*a* or the pressure portion 43 is distorted. As the pressure portion 43 is inserted into the opening 47*a*, these failure states can be visually recognized, an assembly failure can be easily found.

In the case where the holding ring 46 is screwed into the holder 33 to attach the operation member 41 to the outer case 12, it is possible to adjust the degree of compression of the packing portion 42 by adjusting the screwing degree of the holding ring 46. In other words, the sealing performance of the seal potion can be adjusted. The screwing of the female screw portion 48*a* and the male screw portion 35*b* can be released relatively easily. Accordingly, when the maintenance of the seal portion is necessary due to the deterioration of the operation member 41 due to aging and so on, for example, it is possible to take apart the seal portion and replace the operation means 41 easily by removing the holding ring 46.

A force of restoring the packing portion 42 in the sandwiched and elastically deformed state acts on a place where the female screw portion 48*a* is screwed to the male screw portion 35*b*. Accordingly, the state in which the holding ring 46 is attached is maintained. Additionally, as an edge surface of the cylindrical portion 48 closely contacts the outer surface 25*a* of the second shell member 25 forming the outer surface of the outer case 12 connected perpendicular to the holding portion 35 in the first embodiment, the attachment state of the holding ring 46 is maintained.

In the wrist watch 11 having the push-in operation portion 31 assembled as the above, when the push-in portion 43 of the operation member 41 included in the push-in operation portion 31 is pushed from the outside of the shell 21 with deformation against a spring force of the spring 61, the push shaft 51 is pushed toward the inside of the shell 21 and the tip of the shaft portion 52 of the push shaft 51 presses the contact member 16 arranged so as to face the shaft portion 52. Accordingly, the function assigned to the push-in operation portion 31 to which push-in operation is performed as described above is realized, and for example, a lamp for illuminating the dial window 13 is turned on. After that, the push shaft 51 is pushed back toward the outside of the shell by the spring 61 as the force of push-in operation with respect to the push-in portion 43 is not added. The push-in portion 43 is accordingly pushed back to a state before being pushed by the head portion 53 of the push shaft 51.

In this case, the push shaft 51 moved with the operation of the push-in operation portion 31 as described above is not only supported so that the shaft portion 52 can slide along the wall surface forming the through hole 34*a*, namely, the pipe portion 34 through the packing 55 but also supported so that the head portion 53 of the push shaft 51 can slide along the inner peripheral surface of the supporting portion 36. Accordingly, as the movement of the push shaft 51 is guided by the pipe portion 34 and the supporting portion 36, it is possible to allow the push shaft 51 to be in the axial direction more stably.

The waterproofing with respect to the inside of the operation member 41 of the wrist watch 11 in water and so on is realized by the annular sealing portion, namely, the place where the bearing surface 35*a* included in the holding portion 35 of the shell 21 and the pressure portion 47 of the holding ring 46 sandwich the packing portion 42 of the operation member 41 which is compressed in the thickness direction.

As the presser portion 47 has the same ring shape as the bearing surface 35*a*, variations hardly occur in the sealing performance at respective positions of the seal portion. The seal portion can be formed by pressing out and compressed uniformly over the entire circumference of the ring-shaped packing portion 42. Accordingly, the sealing performance for waterproofing and dustproofing the inside of the operation member 41 can be stabilized.

Furthermore, as the holding portion 35 and the holding ring 46 arranged around the holding portion 35 is not moved improperly, the seal portion is not moved when the pressure portion 43 is pressed or the push-in portion 43 is restored to the state before being pushed. In other words, the seal portion can maintain the sealing performance, not being affected by the movement of the push-in portion 43. Therefore, the sealing performance in the seal portion having the packing portion 42 does not become unstable. Additionally, as the packing portion 42 of the seal portion does not move, the sealing performance does not become unstable in the seal portion due to abrasion of the packing portion 42.

Accordingly, waterproof property in the push-in operation portion 31 is improved. Therefore, the push-in operation portion 31 can be operated in water. Moreover, the seal portion for the waterproofing by the packing 55 attached to the push shaft 51 is further provided between the seal portion and the inside of the shell 21 in the first embodiment. It is possible to prevent foreign matter such as water and grains of sand from entering the inside of the shell 21 more positively by the above double sealing. In this case, as it is possible to prevent foreign matter such as grains of sand from entering the inside seal portion having the packing 55 on the inside of the shell 21 by the seal portion on the outside having the packing 42, it is possible to prevent the foreign matter from being bitten between the packing 55 and the pipe portion 34. Accordingly, the performance of the seal portion for the waterproofing by the packing 55 is maintained, thereby keeping the waterproof performance. Additionally, as the foreign matter is not bitten, the reduction in operationality of the push-in operation portion 31 can be prevented, in other words, it is possible to prevent the operation of pushing and moving the push shaft 51 from becoming heavy.

Furthermore, as the holding ring 46 having the packing portion 42 for waterproofing the inside of the operation member 41 attaches the operation member 41 to the outer case 12 by the cylindrical portion 48, a part for fixing the holding ring 46 including the pressure portion 47 for compressing the packing portion 42 to the outer case 12 is not necessary. Accordingly, the structure of the push-in operation portion 31 formed by including the holding portion 35, the operation member 41 and the holding ring 46 can be simplified.

In the wrist watch 11 according to the first embodiment as described above, it is possible to improve waterproof property in the push-in operation portion 31 with the simple structure.

Figure 4:
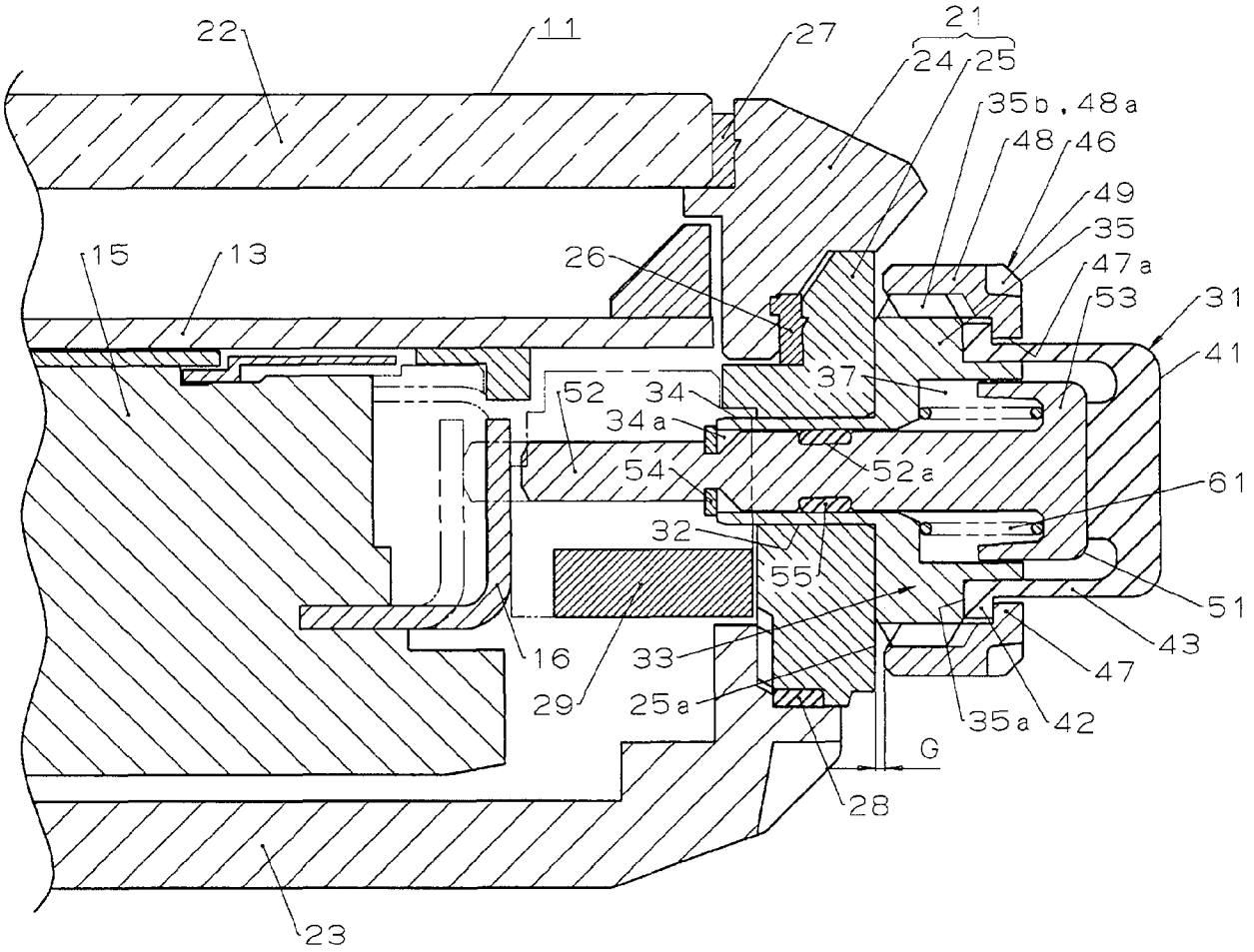
FIG. 4 is a cross-sectional view corresponding to FIG. 2 showing a wrist watch according to a second embodiment of the present invention.

FIG. 4 shows a second embodiment of the present invention. Structures of the second embodiment are the same as the first embodiment except the following description, therefore, the same structures or structures having the same functions as the first embodiment will be denoted by the same numerals and the explanation will be omitted.

In the second embodiment, an end face of the cylindrical portion 48 included in the holding ring 46 is apart from an outer surface 25*a* of the second shell member 25 in the state where the push-in operation portion 31 is assembled, and a gap G is provided between them. Other structures of the second embodiment are the same as the wrist watch 11 of the first embodiment including structures not shown in FIG. 4.

Accordingly, also in the second embodiment, it is possible to provide the wrist watch 11 capable of improving waterproof property in the push-in operation portion 31 with a simple structure according to the reasons explained in the first embodiment. Additionally, the holding ring 46 can be screwed into the holding portion 35 until the gap G disappears in the second embodiment. The deeper the screwing is, the stronger the compression degree of the packing portion 42 becomes. Accordingly, when deterioration of the sealing performance in the seal portion including the packing portion 42 due to aging and so on is predicted, it is possible to respond to the deterioration. That is, the packing portion 42 is further compressed by allowing the screwing of the holding ring 46 to be deeper, thereby improving the sealing performance of the seal portion including the packing portion 42.

Figure 5:
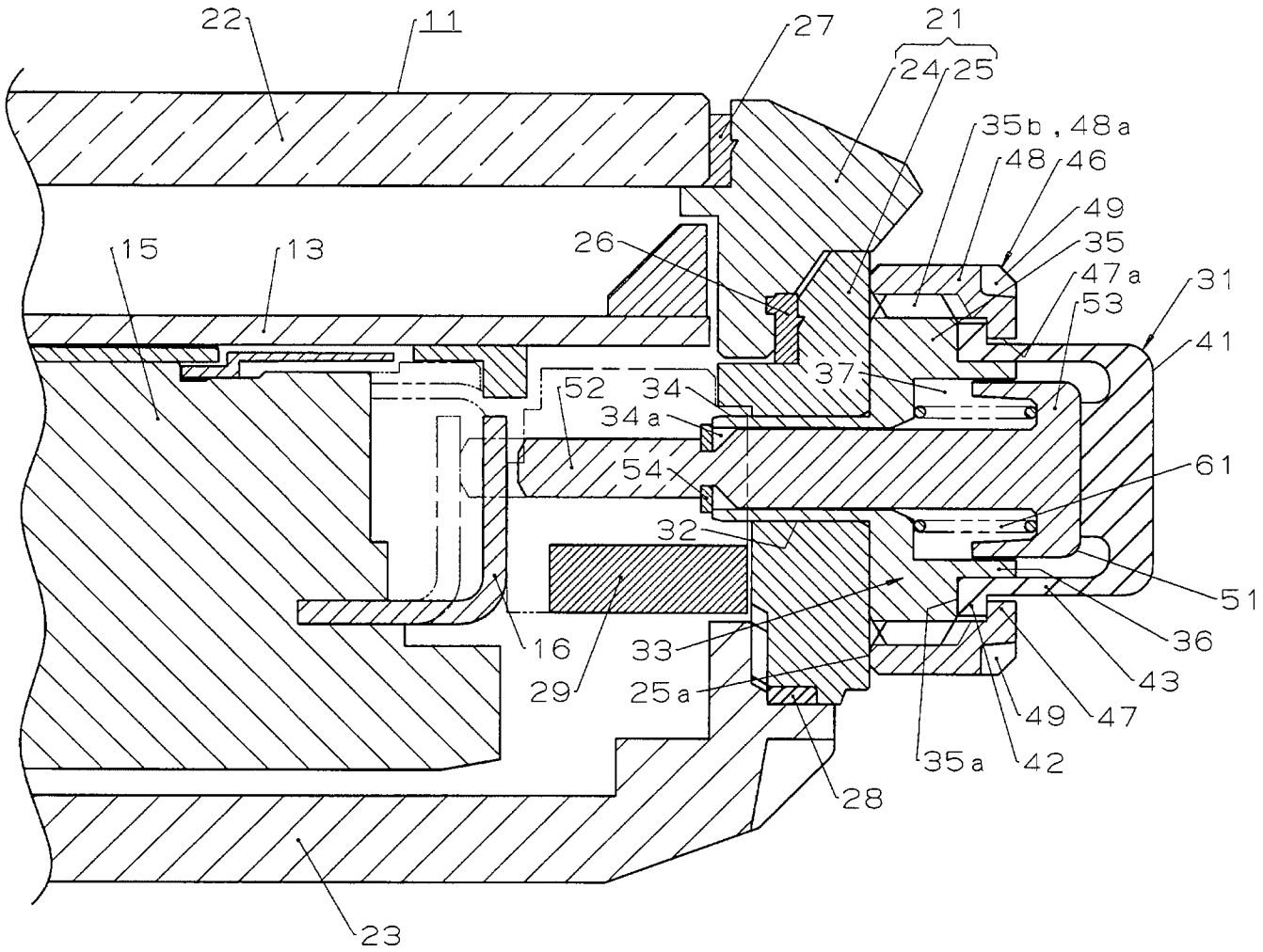
FIG. 5 is a cross-sectional view corresponding to FIG. 2 showing a wrist watch according to a third embodiment of the present invention.

FIG. 5 shows a third embodiment of the present invention. Structures of the third embodiment are the same as the first embodiment except the following description, therefore, the same structures or structures having the same functions as the first embodiment will be denoted by the same numerals and the explanation will be omitted.

In the third embodiment, the packing used in the first embodiment for performing sealing with respect to the pipe portion 34 as the wall sectioning the through hole 34*a* is omitted. This omission can be realized by providing the seal portion including the packing portion 42 on the outside of the shell as compared with the pipe portion 34. Then, the shaft portion 52 of the push shaft 51 pierces the pipe portion 34 sectioning the through hole 34*a* of the shell 21 so as to slidable. Other structures of the third embodiment are the same as the wrist watch 11 of the first embodiment including structures not shown in FIG. 5.

Accordingly, also in the third embodiment, it is possible to provide the wrist watch 11 capable of improving waterproof property in the push-in operation portion 31 with a simple structure according to the reasons explained in the first embodiment. Additionally, the number of parts is further reduced with the omission of the packing used in the first embodiment, which can contribute to the reduction of costs.

Furthermore, when there exists the packing which can slide along the inner surface of the pipe portion 34, the inner surface of the pipe portion 34 is abraded due to the sliding of the packing, therefore, there is a danger that the waterproof performance inside the pipe portion 34 is gradually reduced during the use for a long period of time. There is also a danger that foreign matter grown and separated from the packing in a fluffy form due to the abrasion caused by sliding movement is bitten between the packing and the pipe portion 34, which may gradually reduce the waterproof performance inside the pipe portion 34. However, such concern does not occur as there exist no packing which can slide along the inner surface of the pipe portion 34 in the third embodiment.

Figure 6:
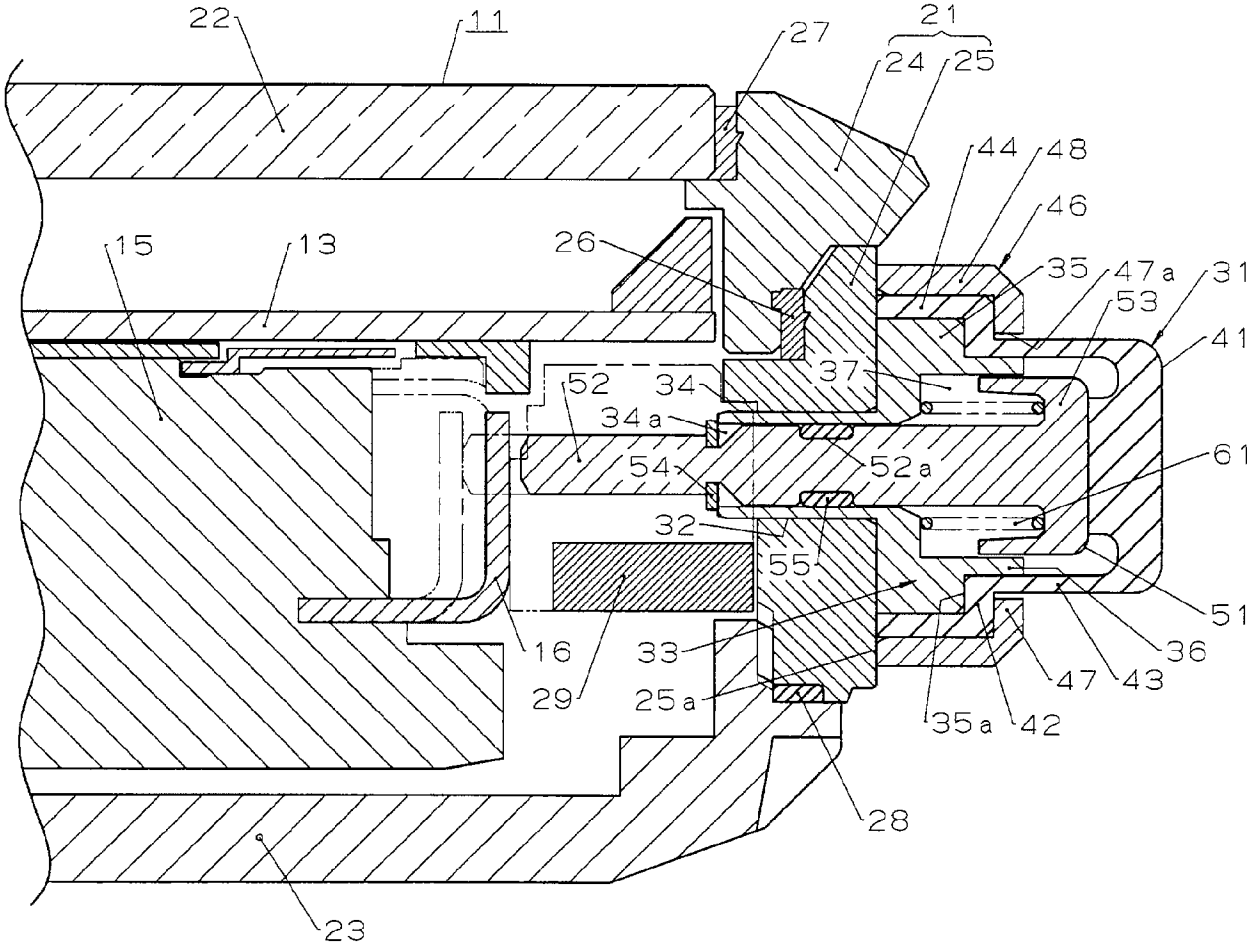
FIG. 6 is a cross-sectional view corresponding to FIG. 2 showing a wrist watch according to a fourth embodiment of the present invention.
Figure 7:
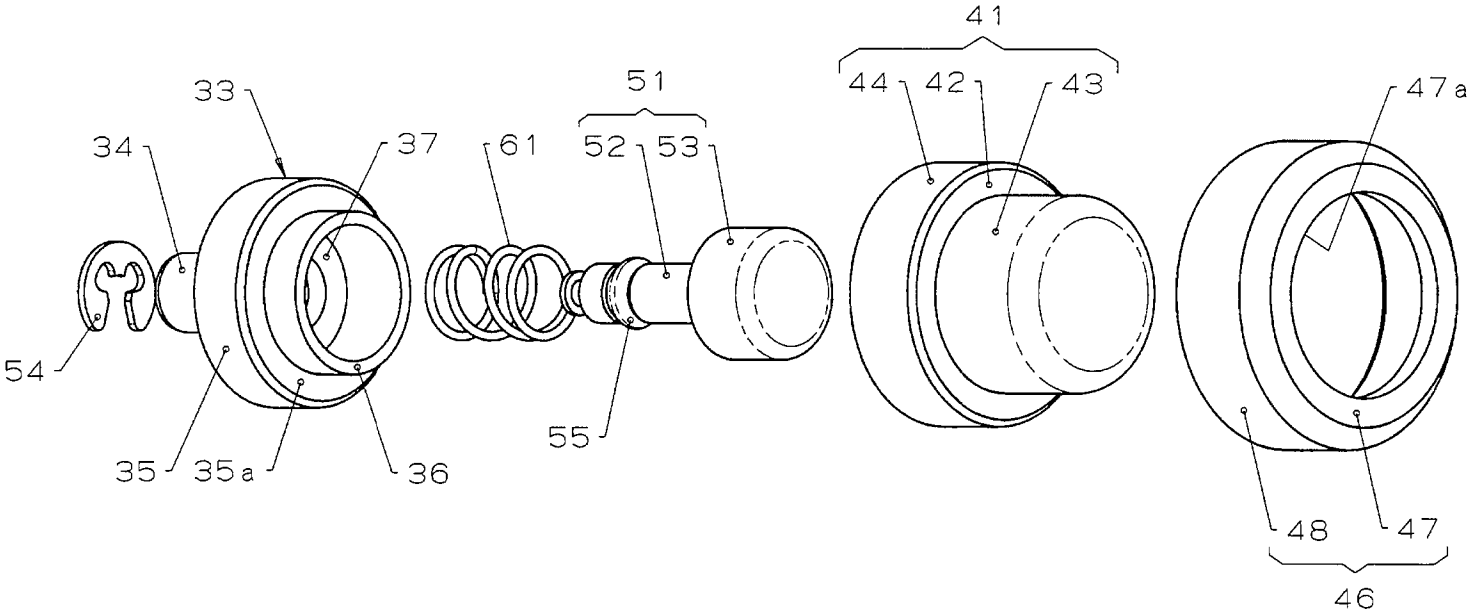
FIG. 7 is a perspective view showing a push-in operation portion included in the wrist watch of FIG. 6 in an exploded manner.

FIG. 6 and FIG. 7 show a fourth embodiment of the present invention. Structures of the fourth embodiment are the same as the first embodiment except the following description, therefore, the same structures or structures having the same functions as the first embodiment will be denoted by the same numerals and the explanation will be omitted.

The fourth embodiment differs from the first embodiment in a structure in which the operation member 41 is attached to the holding portion 35. Specifically, the outer periphery of the holding portion 35 in the holder 33 included in the shell 21 has a circular shape, and the male screw portion applied in the first embodiment is omitted. Accordingly, the inner periphery of the cylindrical portion 48 included in the holding ring 46 has a circular shape, and the female screw applied in the first embodiment is omitted. The inside diameter of the cylindrical portion 48 is larger than the outer diameter of the holding portion 35.

Furthermore, the operation member 41 includes a cylindrical sandwiched portion 44. The sandwiched portion 44 is integrally formed with the packing portion 42. The sandwiched portion 44 protrudes on the opposite side of the push-in portion 43 when the packing portion 42 is a boundary, forming a maximum diameter portion of the operation member 41. The sandwiched portion 44 is fitted to the outer periphery of the holding portion 35. Accordingly, the operation member 41 is provided so as to cover the holding portion 35 and the supporting portion 36 in a state where the inner surface thereof contacts the outer periphery of the holding portion 35, the bearing surface 35*a* of the holding portion 35 and the outer periphery of the supporting portion 36.

The cylindrical portion 48 of the holding ring 46 is arranged around the holding portion 35 in a state of being pressed in the outer periphery of the sandwiched portion 44. The sandwiched portion 44 is sandwiched in a state of being compressed in the thickness direction of this portion between the holding portion 35 and the cylindrical portion 48. Accordingly, the operation member 41 is attached to the holding portion 35 as well as the push-in operation portion 31 is assembled. According to the assembly, the packing portion 42 of the operation member 41 is held in a state of being sandwiched between the bearing surface 35*a* and the pressure portion 47 contacting the packing portion 42 in the thickness direction in a compressed state.

Structures of the fourth embodiment other than the structure explained above are the same as the wrist watch 11 of the first embodiment including structures not shown in FIG. 6 and FIG. 7.

Accordingly, also in the fourth embodiment, it is possible to provide the wrist watch 11 capable of improving waterproof property in the push-in operation portion 31 with a simple structure according to the reasons explained in the first embodiment. Additionally, in the fourth embodiment, the sandwiched portion 44 sandwiched between the holding portion 35 and the cylindrical portion 48 in a compressed state and connected to the packing portion 42 fulfills the waterproof performance. Accordingly, as a long waterproof distance in the push-in operation portion 31 can be secured, the waterproof performance can be further improved.

Additionally, even when a turning force is added to the holding ring 46 pressed in the outer periphery of the sandwiched portion 44 in the fourth embodiment, the holding ring 46 is hardly turned improperly. Accordingly, the structure is suitable to maintain the sealing performance in the seal portion including the packing portion 42.

Additionally, as the attachment of the operation member 31 to the outer case 12 is realized by pressing the cylindrical portion 48 of the holding ring 46 in the outer periphery of the sandwiched portion 44 of the operation member 41 fitted to the outer periphery of the holding portion 35, it is not necessary to form a screw portion both in the holding portion 35 and the cylindrical portion 48. Therefore, processing costs with respect to the holding portion 35 and the cylindrical portion 48 are reduced, which can contribute to the overall cost reduction.

In the above respective embodiments, the shapes of the bearing surface, the packing portion and the pressure portion are the annular shape with the circular outer periphery, however, the present invention is not limited to the above, and for example, the shape of the outer periphery may be a square shape or a polygonal shape.

What is claimed is:

1. A portable device comprising:

a device outer housing forming an exterior of the portable device;

a holder fixed to the device outer housing, the holder comprising a generally tubular holding portion extending outside of the device outer housing and a pipe portion integrally connected to the holding portion and extending inside of the device outer housing, wherein the holding portion comprises a first tubular wall and a second tubular wall extending in a coaxial manner from the first tubular wall outside of the device outer housing, and an outer periphery of the first tubular wall is radially larger than an outer periphery of the second tubular wall, so that in which a bearing surface is formed which continues between the outer peripheries of the first and second tubular walls:

a generally tubular operation member made of a soft material having waterproof performance and including a packing portion and a push-in portion integrally connected to the packing portion, the push-in portion being positioned around the second wall of the holding portion so that the packing portion of the operation member is seated on the bearing surface of the holding portion;

a push shaft positioned inside the holder in such a manner that the push shaft is slidably received in a through-hole of the pipe portion of the holder, the push shaft being operably connected to the push-in portion of the operation member so as to be slidably movable in the pipe portion by pushing operation of the push-in portion of the operation member; and a holding ring including a generally cylindrical portion having an opening through which the push-in portion of the operation member extends out of the holding ring for the pushing operation, the holding ring further including an annular presser portion radially inwardly projecting from the cylindrical portion inside the cylindrical portion, the cylindrical portion being secured around the first and second walls of the holding portion so that the presser portion of the holder ring presses the packing portion of the operation member against the bearing surface of the holding portion inside the holding ring and secures the operation member to the holding portion of the holder.

2. The portable device according to claim 1, wherein the outer periphery of the first wall of the holding portion is formed with a male screw portion, and the cylindrical portion of the holding ring is formed with a female screw portion at an inner periphery thereof which is engaged with the male screw portion of the holding portion to secure the holding ring to the holder and secure the operation member to the holding portion of the holder.

3. The portable device according to claim 2, wherein the holding ring has first and second axial ends, and the second axial end is located on an axially inner side than the first axial end with respect to the device outer housing and has a clearance for movement toward the device outer housing so that the presser portion of the holder ring can press the packing portion of the operation member more tightly against and the bearing surface of the holding portion.

4. The portable device according to claim 1, wherein the operation member further includes an extension extending from the packing portion towards inside of the device outer housing so as to be fitted around the outer periphery of the first wall of the holding portion, and the cylindrical portion of the holding ring is secured around the extension so as to compress the extension against the first wall of the holding portion.

5. The portable device according to claim 1, wherein the outer periphery of the second wall of the holding portion extends perpendicular to the bearing surface of the holding portion and supports the push-in portion of the operation member from inside of the push-in portion.

6. The portable device according to claim 5, wherein an inside diameter of the second wall of the holding portion is larger than an inner diameter of the through hole of the pipe portion of the holding portion, and the push shaft includes a head portion slidablv moveable along an inner periphery of the second wall.

7. The timepiece according to claim 6, further comprising a shell secured to the device outer housing, the shell having a pipe mounting hole through which the pipe portion of the holder is inserted.

8. A portable timepiece formed by a portable device according to claim 7.

9. A portable timepiece formed by a portable device according to claim 6.

10. The portable device according to claim 5, further comprising a shell secured to the device outer housing, the shell having a pipe mounting hole through which the pipe portion of the holder is inserted.

11. A portable timepiece formed by a portable device according to claim 10.

12. A portable timepiece formed by a portable device according to claim 5.

13. The portable device according to claim 1, further comprising a shell secured to the device outer housing, the shell having a pipe mounting hole through which the pipe portion of the holder is inserted.

14. A portable timepiece formed by a portable device according to claim 13.

15. A portable timepiece formed by a portable device according to claim 1.

* * * * *

UNITED STATES PATENT AND TRADEMARK OFFICE

CERTIFICATE OF CORRECTION

PATENT NO. : 9,028,134 B2
APPLICATION NO. : 14/184302
DATED : May 12, 2015
INVENTOR(S) : Hideaki Koshoji et al.

It is certified that error appears in the above-identified patent and that said Letters Patent is hereby corrected as shown below:

In the Claims

In column 14, claim 1, line 33, before “a bearing surface” delete “in which”.

In column 14, claim 1, line 35, after “tubular” replace “walls:” with --walls;--.

In column 16, claim 6, line 2, after “head portion” replace “slidablv” with --slidably--.

Signed and Sealed this
Tenth Day of November, 2015

Michelle K. Lee

Michelle K. Lee
*Director of the United States Patent and Trademark Office*